US005177917A

United States Patent [19]

del Castillo Von Haucke

[11] Patent Number: 5,177,917

[45] Date of Patent: Jan. 12, 1993

[54] MODULAR PANEL WALL STRUCTURE

[76] Inventor: Juan M. del Castillo Von Haucke, Col. Roma,, Salamanca No. 34, 06700 Mexico, D.F., Mexico

[21] Appl. No.: 801,511

[22] Filed: Dec. 2, 1991

[51] Int. Cl.[5] ..... E04B 2/42

[52] U.S. Cl. ..... 52/220; 52/221; 52/236.7; 52/236.9; 52/481

[58] Field of Search ..... 52/220, 236.7, 236.9, 52/238.1, 239, 221, 481, 241

[56] References Cited

U.S. PATENT DOCUMENTS

| | | | |
|---|---|---|---|
| 2,766,858 | 8/1956 | Johnson et al. | 52/241 |
| 3,195,698 | 6/1965 | Codrea | 52/239 |
| 3,465,488 | 9/1969 | Miller | 52/481 |
| 3,999,343 | 12/1976 | Roberts | 52/241 |
| 4,269,005 | 5/1981 | Timmons | 52/36 |
| 4,896,469 | 1/1990 | Wright | 52/221 |
| 4,905,428 | 3/1990 | Sykes | 52/126.4 |

*Primary Examiner*—Richard E. Chilcot, Jr.
*Assistant Examiner*—Matthew E. Leno
*Attorney, Agent, or Firm*—Karl W. Flocks

[57] ABSTRACT

Modular wall panel structure comprising panels having a supporting skeleton of stiles, rails, and mullions of substantially uniform hollow rectangular section and wherein each vertical margin of a panel includes two spaced stiles and wherein each panel includes two spaced bottom rails as well as a top rail and two spaced mullions extending vertically from the top rail to an uppermost bottom rail.

10 Claims, 5 Drawing Sheets

FIG. 1
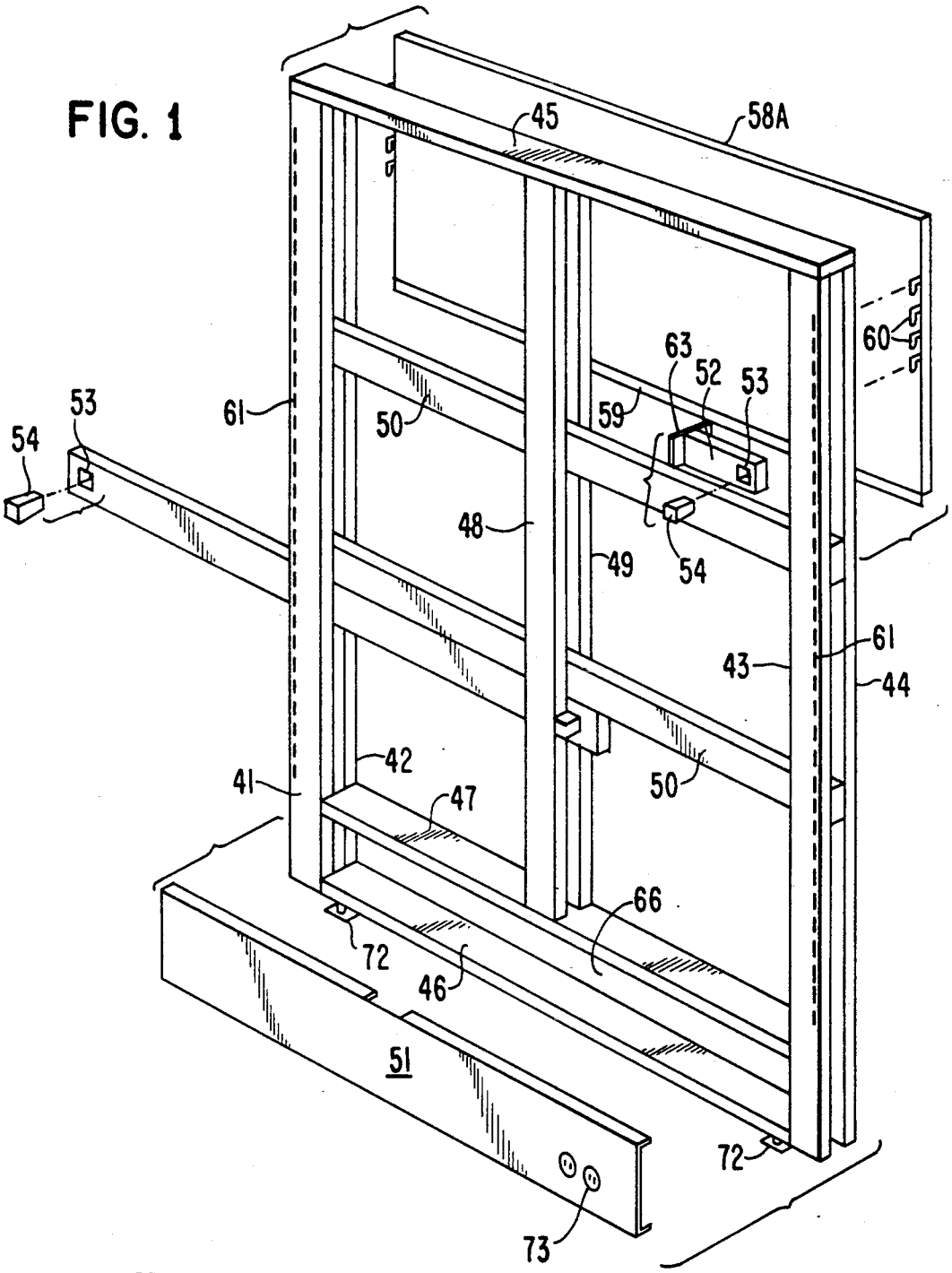
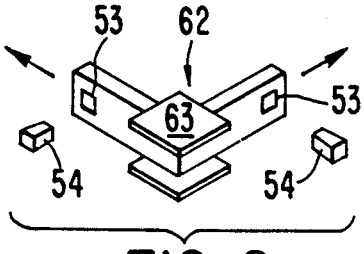
FIG. 9
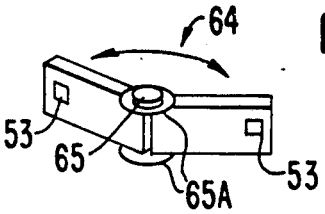
FIG. 12

FIG. 5
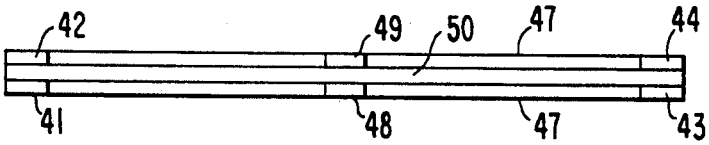
FIG. 4
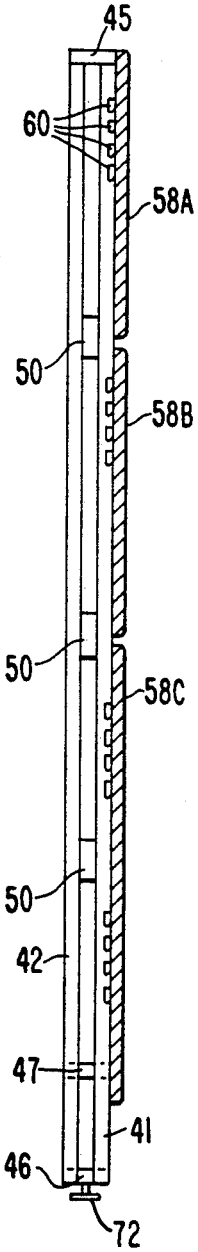
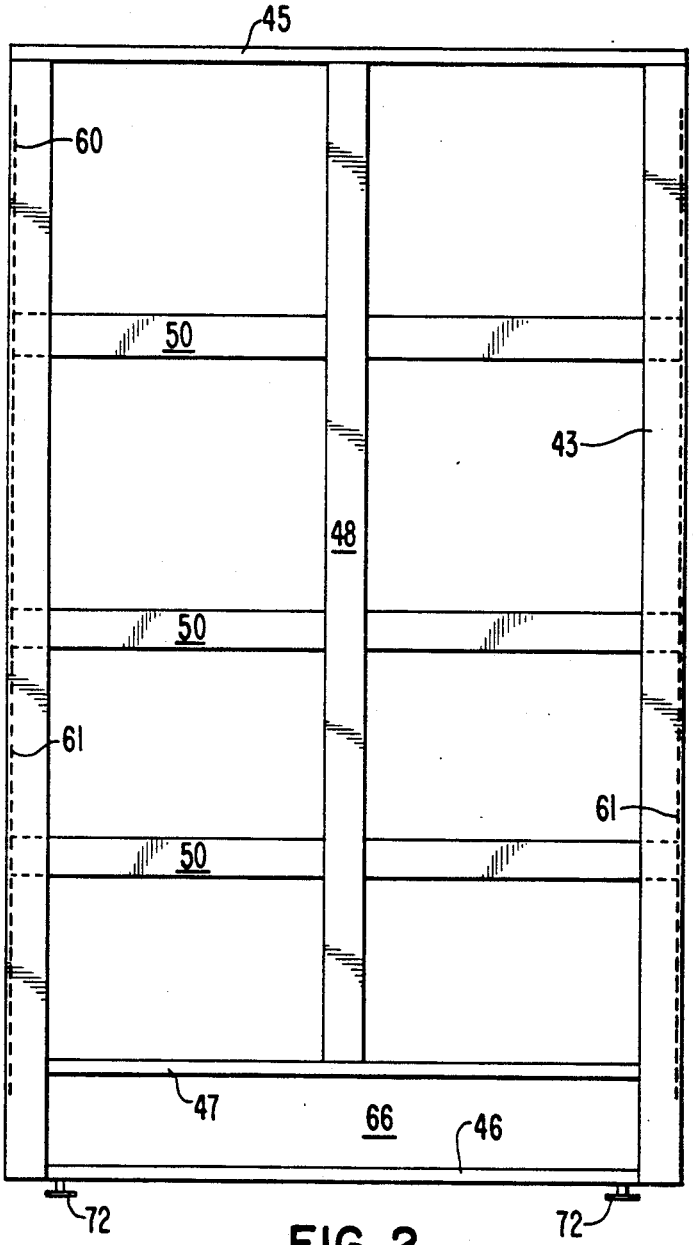
FIG. 2
FIG. 3
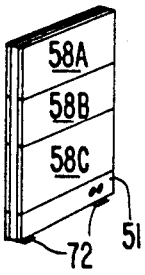

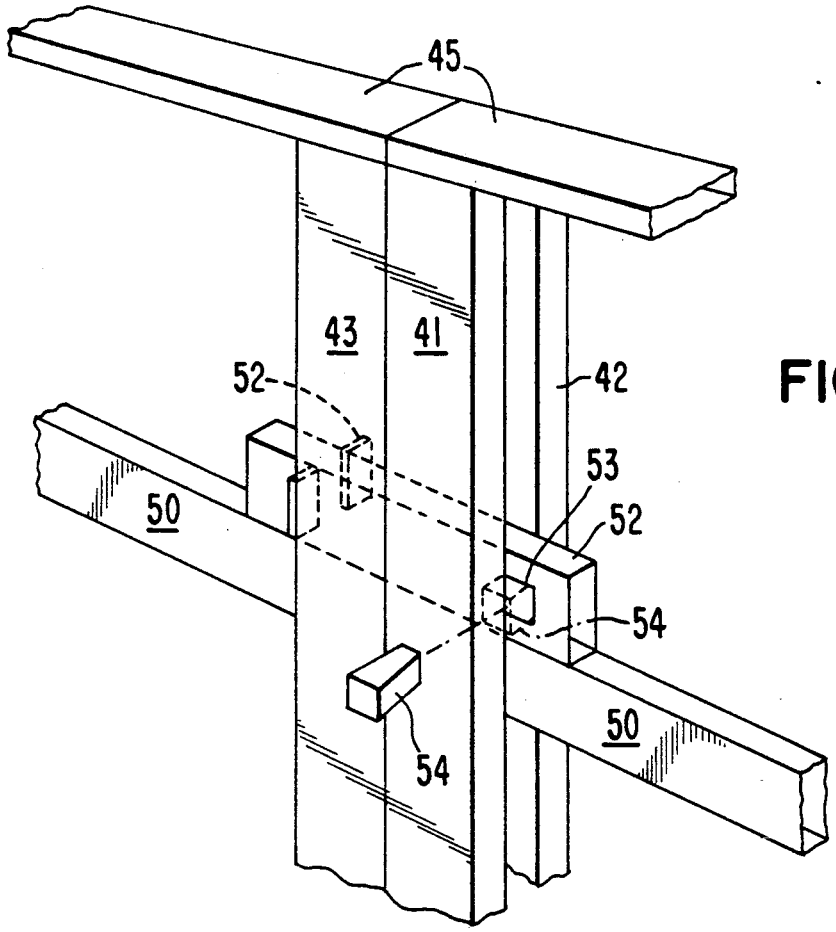
FIG. 6
FIG. 7
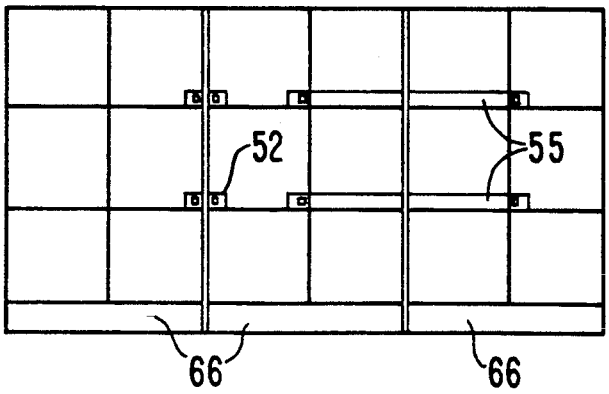
FIG. 8
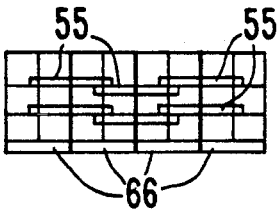

MODULAR PANEL WALL STRUCTURE

This invention related to wall structure and, more particularly, to a modular office wall panel structure and assembly system.

BACKGROUND OF THE INVENTION

Prior to the instant invention, many workers were operating in the universe of office furniture and they did produce cubicle structures, modular office units including pre-fabricated panels for assembly on the job; that is at the time of field installation. Prior workers used many expedients to assemble the parts of an office cubicle and office furniture and office paneling. Examples of prior work include the disclosure in my U.S. Pat. No. 4,928,465, of May 29, 1990, and in my U.S. Pat. No. 4,807,539, of Feb. 28, 1989, and the patents cited therein, including the following:

| | | |
|---|---|---|
| Richter | 2,908,400 | October, 1959 |
| Vaeth | 3,069,216 | December, 1962 |
| Pearce et al | 4,056,897 | November, 1977 |
| Takahashi | 4,153,311 | May, 1979 |
| Densen | 4,463,997 | August, 1984 |
| Turner | 4,560,215 | December, 1985 |
| Wright | 4,582,002 | April, 1986 |
| Arens | 4,493,174 | January 15, 1985 |
| Watkins | 3,327,440 | June 27, 1967 |

Prior workers strove mightily to simplify construction and assembly and they utilized expedients such as slots and male members fitting in such slots, as well as conventional nuts and bolts and special hardware.

Competition among prior workers abounded because of the great need for efficiency, economy, and facility in assembly. The need for saving time and material was readily recognized, but final solutions remained unsolved. Prior constructions which were assembled quickly were not always stable. Stable Prior constructions were too costly in the fact of the competition.

Compromises in prior constructions were not entirely satisfactory. With all the effort that went into the work by those engaged in this endeavor, the solution to the problems of producing modular wall panels, modular wall structures, and modular wall systems in a manner serving the needs of the industry, taking into account economy, facility, and new technical requirements, remained for Applicant.

SUMMARY OF THE INVENTION

An object of the present invention is to produce a wall structure including a pre-fabricated panel comprising two pairs of stiles, a top rail, and two vertically spaced bottom rails forming a service conduit raceway.

It is a further object of the invention to provide a prefabricated panel utilizing two bottom hollow metal rails and two sets of vertical stiles of substantially similar rectangular cross section each having a major axis and a minor axis assembled in such manner that the major axes of the cross sections of the stiles are at right angles to the major axes of the cross sections of the rails.

It is an object of the instant invention to provide a wall structure including a panel having a top rail and two bottom rails and stiles of substantially similar cross section with the stiles being two in number at each side margin of each panel and with said stiles at each side margin being spaced from each other to receive and be secured to an intermediate rail.

It is still another object of the instant invention to provide a novel panel structure for integration with similar panel structures with the utilization of connectors to produce strong, stable walls and partitions in planar form, in angular form, in "T"-shape, and in "X"-shape.

Still a further object is to produce a novel wall structure of modular panel armatures or skeletons skinned with novel surface sheet-like elements which cooperate with the skeletonized panels to facilitate the installation of service conduits, electric wires, as well as supports for book shelves, other horizontal surfaces for supporting machines, apparatus of various kinds, and other utilitarian elements.

Other objects and the nature and advantages of the instant invention will be apparent from the following description:

BRIEF DESCRIPTION OF THE DRAWINGS

FIG. 1 is a view in perspective of an armature or skeleton of a panel wall structure with parts exploded therefrom and ready for assembly therewith;

FIG. 2 is a front elevation of another similar armature or skeleton of a panel wall structure with a larger number of rails than those of the structure shown in FIG. 1 with the front side exposed and unskinned;

FIG. 3 is a reduced perspective view of the panel wall structure with the exposed face being viewed fully skinned with horizontal extending sheet formations;

FIG. 4 is a side or end elevation of the structure illustrated in FIG. 2 with its skin elements of horizontally extending sheet formations shown in section as vertically partially cut away;

FIG. 5 is a top plan view with top rail removed of the unskinned armature or skeleton structure of FIG. 1;

FIG. 6 is a fragmentary perspective view with a part exploded of portions of two armatures or skeletons having adjacent stiles locked together by a connector wing or canard element and secured by a wedge;

FIG. 7 is a reduced front elevation of a skeletonized three adjacent panel wall structure, the first two panels of which are locked together by a relatively short connector wing or canard and the second and third panel of which are locked together by a relatively long connector wing or canard to promote rigidity.

FIG. 8 is a further reduced front elevation of another skeletonized adjacent panel wall structure in which all three panels are locked together by three upper and three lower relatively long connector wings or canards which provide substantial rigidity.

FIG. 9 is a partially exploded view in perspective of a fixed right-angle connector or canard illustrating mating wedges and rectangular orifices having bearing surfaces suitable for use in association with one pair of stiles of the armature or skeletonized panel of FIG. 1;

FIG. 12 is a perspective of an adjustable angle connector wing or canard suitable for use in association with the armature or skeletonized panel structure illustrated in FIG. 1;

DETAILED DESCRIPTION OF THE INVENTION

Figure 10:
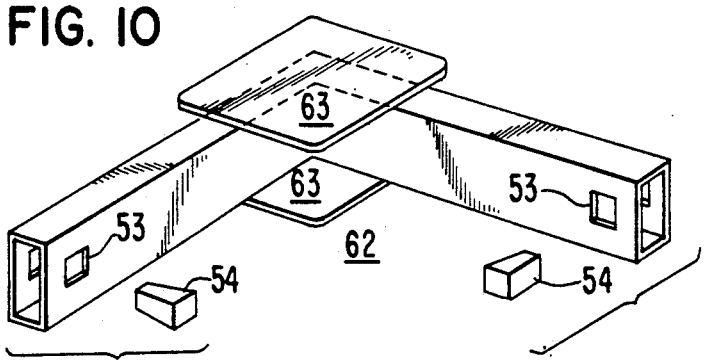
FIG. 10 is a perspective view of the connector wing or canard shown in FIG. 9 but slightly enlarged and taken from an opposite viewpoint.

Referring to the drawings, and more particularly, to FIGS. 1–8, the armature or skeleton therein illustrated includes a first pair of stiles 41 and 42 on one end, and a second pair of stiles 43 and 44 on the opposite end. The armature or skeleton is capped by the top rail 45. The armature or skeleton also includes a first bottom rail 46 and vertically thereabove a second bottom rail 47, so as to provide a conduit, or electrical circuit, or service, raceway 66 midway between the first pair of stiles 41 and 42 and the second pair of stiles 43 and 44 adapted to be faced with the cover 51 which has provision for sockets 71. The pair of vertical mullions 48 and 49 extends between the upper surface of the second bottom rail 47 and the lower surface of the top rail 45.

Extending horizontally between the first pair of stiles 41 and 42 and the second pair of stiles 43 and 44 and intermediate the second bottom rail 47 and the top rail 45 is a series of intermediate rails 50. FIG. 1 shows an armature or skeleton having two intermediate rails 50 whereas FIG. 2 discloses a similar armature or skeleton having three intermediate rails 50.

It is significant that each and every one of the rails and stiles described has a cross-sectional major axis of three times the dimension of its cross-sectional minor axis. With such construction the service raceway can act as a manifold to permit the position of service lines upwardly between each pair of stiles and under or over each intermediate rail and be available to be passed to a place of utilization by technical apparatus or utility.

FIGS. 3 and 4 illustrate a skin for the armature or skeleton comprising three horizontally extending sheet like forms 58A, 58B, and 58C. These sheet-like forms are provided on their inner surface near their side margins with hooks 60 adapted to cooperate with mating slits 61 formed in the stiles 41 and 43 and also 44 and 42.

Referring particularly to FIG. 6 and also to a portion of FIG. 1, the relatively short connector wing canard 52 is illustrated rigidly associated to armatures or skeletons in locked position as in FIG. 6 or in position of readiness for such association as in FIG. 1. The stop 63 is adapted to engage or engages the stiles 43 and 44 and the wedge 54 when inserted in the orifice 53 is adapted to or does engage the stiles 41 and 42 of an adjacent armature or skeleton.

Referring to FIGS. 7 and 8, relatively short connector canards 52 and relatively long connector wing canards 55 utilized in a three-panel wall structure as in FIG. 7 and six relatively long connector wing canards 55 are utilized to lock four panels into an aligned wall structure, as in FIG. 8.

Figure 11:
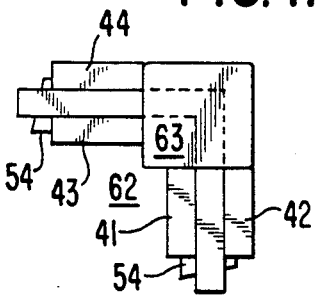
FIG. 11 is a top plan view on a somewhat different scale of the right angle connector wing or canard shown in FIGS. 9 and 10 and with the wedges in place.

Referring to FIGS. 9, 10, 11, the right angle connector wing canard is illustrated ready for installation as in FIG. 11. The right angle connector wing canard 62 includes the stop plates 63 which are adapted to engage corresponding stiles and the wedges 54 adapted to be associated with the orifices 53 as already described in connection with the relatively short connector wing canard 52.

Figure 13:
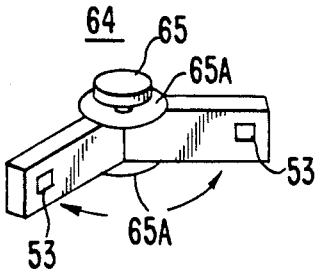
FIG. 13 is a view similar to that of FIG. 12 of an angular connector wing or canard which is adjustable and which is taken from an opposite point of view.
Figure 14:
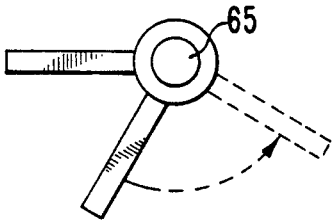
FIG. 14 is a plan view of the element shown in FIG. 13 with parts shown in solid lines arranged to be locked in an acute angle and in dotted lines illustrating an arrangement of an obtuse angle with an arrow showing how the element can be moved from an acute angle configuration.

The adjustable connector wing canard 64 illustrated in FIGS. 12 and 13 includes a knurled headed bolt 65 which acts as a hinge pintle and stops 65A. The arms of the connector wing canard 64 can be set at an obtuse angle as in FIG. 13 or at an acute angle as in FIG. 14.

Figure 15:
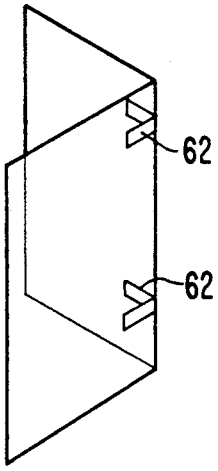
FIG. 15 is a schematic view of two panels arranged at right angles and being locked together by two right angle connector wings or canards vertically spaced from each other.
Figure 16:
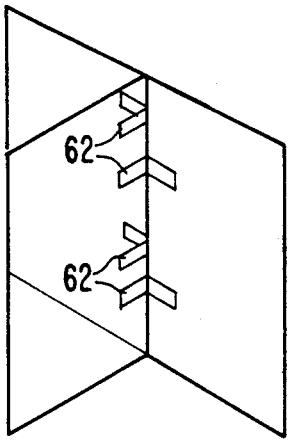
FIG. 16 is a view similar to that of FIG. 15 but illustrating a panel "T" formation locked together by four vertically spaced connector wings or canards.
Figure 17:
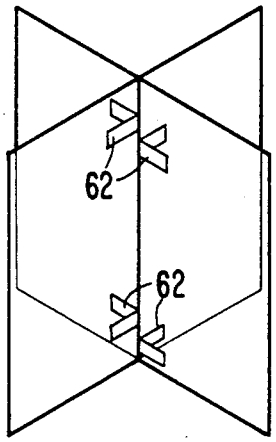
FIG. 17 is a view similar to that of FIGS. 15 and 16, but illustrating a wall structure of "X" formation wherein the adjacent panels are locked together by four connector wings or canards of the character illustrated in FIGS. 9, 10, and 11.

Referring to FIGS. 15, 16, and 17, which are schematic in nature, the "L"-shaped configuration of wall structure panel assembly is locked by two vertically spaced right angle connector wing canards. The assembly of "T" formation as illustrated in FIG. 16 is held in locked position by four right angle connector wing canards 62, each of which is vertically spaced from each other and so oriented that all three panels are rigidly engaged. The "X" formation of panels schematically illustrated in FIG. 7 are held in locked position by four connector wing canards as illustrated with the arms of the connectors so oriented as to engage all four panels.

Figure 18:
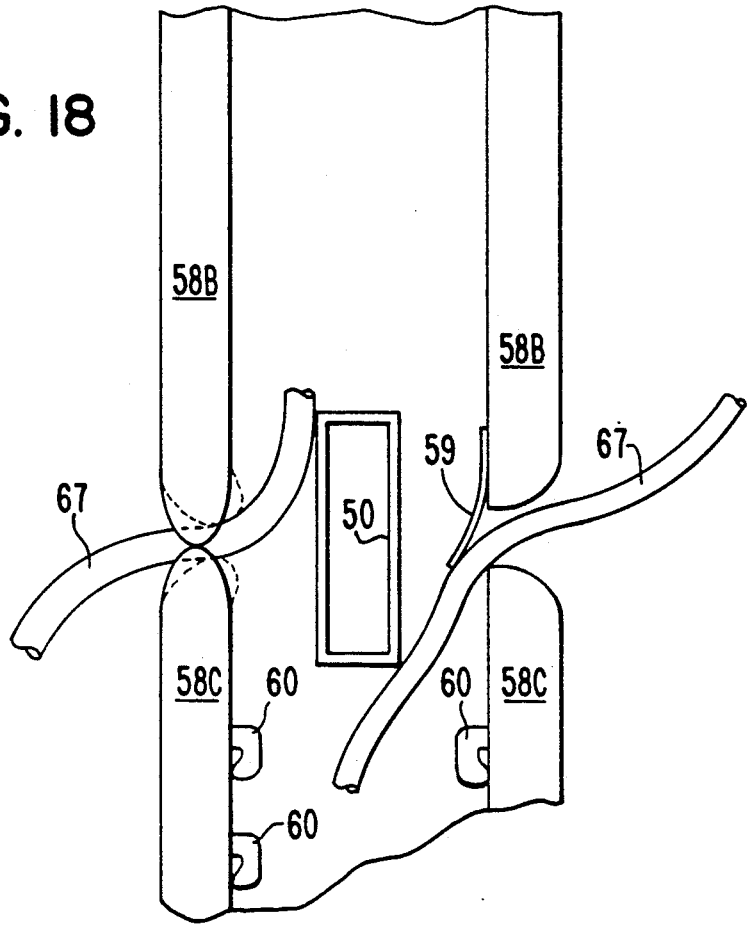
FIG. 18 is a fragmentary vertical cross-section with elements removed for clarity and with parts shown in section and with parts shown in elevation illustrating paths of conduits or wires passing from the interior of the skeletonized panel through the space between adjacent margins of panel skins to the exterior of the wall structures.
Figure 19:
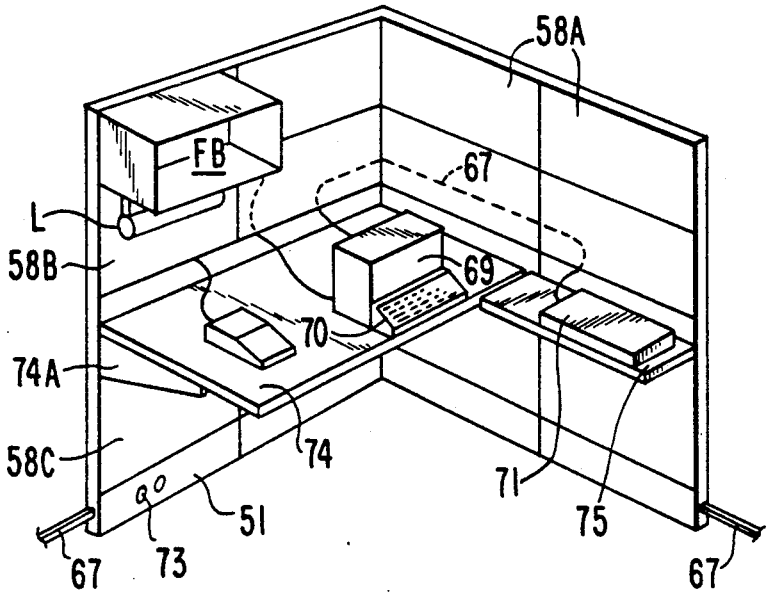
FIG. 19 is a schematic view in perspective of a corner of an office space utilizing a right angle or L-shaped wall structure assembled from pre-fabricated panels showing the channeling of electrical power supply through connecting raceways acting as manifolds feeding branches extending upwardly through the space between adjacent stiles or between stiles and mullions to locations adjacent utilitarian or technical power consuming elements and apparatus and through the space between adjacent margins of prefabricated panels serving as skin or surface for the wall structure.

Referring to the schematic illustrations of FIGS. 18 and 19, the service line 67, which may be in the form of conduits or cables or electric wires, pass through the raceways 66 which are covered by the elements 51 which raceways 66 act as manifolds so that branches of the service lines may extend upwardly alongside or between stiles and will pass underneath or over an intermediate rail 50 and through an opening pressed between skin elements 58B and 58C or between a flexible lip 59 and a skin element 58C, as illustrated in FIG. 18 and then passed through to a telephone 68, a monitor and keyboard 69 and 70, and a printer 71.

The shelf 74 is supported by the panel structure. Just as the sheet-like forms 58A, 58B, and 58C are provided on their inner surface near their side margins with hook 60 adapted to cooperate with mating slits 61 formed in the stiles 41, 42, 43, and 44, so the shelf 74 and its associated bracket 74A are provided on their inner surface near their side margins with hooks 60 adapted to cooperate with mating slits 61 formed in the stiles. The shelf 74 may also be supported by the panel structure from an intermediate rail 50 by a bracket passed through a pressed or formed opening between the skin elements 58B and C. The shelf 75 may be similarly supported. In addition, many and various types of attachments, such as file bins, book shelves, and the like, not illustrated, may be supported on the panel structure in this manner. FIG. 19 illustrates a file bin FB attached to the panel structure in this manner and there may be located therebeneath a lamp L connected to the electric service coming from the service raceway as already described.

The instant invention advances the art of wall structures and is particularly useful in office wall and partition structures. Here the need is great both from the points of view of the manufacturer or fabricator and the consumer or user. The time spent in manufacturing, the cost of material, the time spent in assembly or installation on the job, each is critical.

Today, with intense competition from the far east, including Japan, Korea, Taiwan, and both Western Europe and Eastern Europe, it is of significance that the instant invention utilize a novel construction which saves both manufacturing time and material and, on top of these savings, provide for additional advantages times in that installation on the job is facilitated, creating good will in the supplier who pleases his or her customer.

The instant invention makes use of metal tubular members. The rails and stiles and mullions are each preferably of 20 gauge steel and is strong in tension and compression. Other steels may be utilized; however, 20 gauge has been found to be eminently satisfactory. They are readily fabricated with today's metal working equipment. Standardizing the rails and stiles in the manner of the instant invention is an important advance particularly in the orientation of the top and bottom rails as to coordinate and facilitate passage or threading of service lines, such as electric wires through a horizontal raceway and then upward and through adjacent horizontal margins of sheet-like skin portions so that apparatus or utilities can be serviced.

Rails and stiles having a three by one cross-sectional proportion serve Applicant's invention. Connector wing canards may be made of the same stock tubular members. While separate wedges and orifices are illustrated and described as panel part engaging elements, the wedges may be connected to the canard by a chain. Instead of utilizing wedges and orifices as engaging expedients, alternate engaging formations may be substituted, such as, for example, cam or lever operated locking devices.

Corner posts and spacer posts can be provided with covers and utilized to enhance the decor.

It is to be understood that the instant invention is not limited to what is illustrated and described herein, but only as recited in the appended claims, having regard for a reasonable interpretation of the Doctrine of Equivalents.

What is claimed is:

1. Modular wall panel having an inside planar face outside and comprising a supporting skeleton of stiles, rails, and mullions of substantially uniform hollow rectangular section each having a major axis and a minor axis;

a first spaced pair of stiles and a second pair of spaced stiles, each of said stiles arranged so that its sectional minor axis extends from the inside planar face to the outside;

a top rail, a first bottom rail and a second bottom rail spaced above and vertically from said first bottom rail, each of said top and bottom rails having its sectional major axis extending from the inside planar face to the outside;

an inside mullion spaced from an outside mullion arranged so that the inside mullion has its sectional minor axis extending from the inside face in the direction of the outside and the outside mullion has its sectional minor axis extending from the outside in the direction of the inside face, said inside and outside mullions extending from the top rail to said second bottom rail;

at least one intermediate rail vertically spaced from said top rail and said second bottom rail across the width of said panel and from stile and disposed between said inside and outside mullions and said supporting skeleton of stiles to stile;

said stiles and first and second bottom rails forming a generally horizontal manifold service conduit raceway;

each pair of spaced stiles arranged to be a conduit service branch from said manifold;

and each pair of spaced stiles forming a base for a connector element which may join said wall panel to a similar panel to form a modular wall having connecting manifold service conduit raceways.

2. A wall structure comprising adjacent modular wall panels in accordance with claim 1, said adjacent panels being locked together by means of one or more connector wing engaging adjacent stiles of adjacent panels;

3. A wall structure comprising adjacent modular wall panels in accordance with claim 1, said panels being locked together by means of one or more connector wing engaging mullions in adjacent panels;

4. A wall structure in accordance with claim 2 wherein adjacent panels are arranged in an "L" formation to provide a corner area;

5. A wall structure in accordance with claim 2 wherein adjacent panels are arranged in a "T" formation to provide two corner areas;

6. A wall structure in accordance with claim 2 wherein adjacent panels are arranged in an "X" formation to provide four corner areas;

7. A wall structure in accordance with claim 4 wherein the two legs of the "L" are at an angle at variance from a right angle;

8. A wall structure in comprising adjacent modular wall panels in accordance with claim 1, said adjacent wall panels being locked together by one or more connector wing engaging panel portions with wedges inserted in orifices formed said connector wing;

9. A modular wall panel in accordance with claim 1, a plurality of sheet-like elements, each removably secured to said panel one above the other to form a skin for said skeleton or armature with a lower horizontal margin of an upper sheet-like element adjacent the upper horizontal margin of a sheet-like element immediately therebelow, service lines passed through said raceway and extended upwardly to a position adjacent an intermediate rail and then between adjacent margins of said sheet-like elements so as to be available to serve apparatus or utilities on one side of said panel;

10. The structure recited in claim 9 and a shelf extending outwardly from an outside of said panel, said shelf having an upper surface substantially in line with adjacent margins of said sheet-like elements.

* * * * *